United States Patent [19]

Arnold

[11] Patent Number: 4,686,742

[45] Date of Patent: Aug. 18, 1987

[54] AUXILIARY HANDLE FOR A DOOR

[76] Inventor: Allan J. Arnold, 1383 W. "E" St., #4, Hastings, Nebr. 68901

[21] Appl. No.: 891,186

[22] Filed: Jul. 31, 1986

[51] Int. Cl.[4] ..... E05B 1/00; E05B 5/02

[52] U.S. Cl. ..... 16/112; 16/110 R; 16/113; 16/DIG. 24; 49/460; 294/58

[58] Field of Search ..... 16/110 R, 112, 113, 16/115, 123, 124, 125, DIG. 24; 294/58; 49/70, 460

[56] References Cited

U.S. PATENT DOCUMENTS 289,669 12/1883 Lewis ..... 16/123
1,487,264 3/1924 Raymer ..... 49/460 X
4,095,372 6/1978 Rittner ..... 49/460
4,288,944 9/1981 Donovan ..... 49/460 X

FOREIGN PATENT DOCUMENTS 910687 11/1962 United Kingdom ..... 49/460

*Primary Examiner*—Fred Silverberg
*Attorney, Agent, or Firm*—Zarley, McKee, Thomte, Voorhees & Sease

[57] ABSTRACT

An auxiliary handle for a door comprising a bracket which is secured to the door adjacent the hinge connection thereof. A handle member is pivotally secured to the bracket and may be moved from an inoperative vertically disposed position to an operative horizontally disposed position. When the handle member is in the operative position, the handle member may be grasped to pull the door to its closed position.

1 Claim, 5 Drawing Figures

AUXILIARY HANDLE FOR A DOOR

BACKGROUND OF THE INVENTION

It is extremely difficult for a person in a wheelchair to close a door after passing through the door. When the person in a wheelchair attempts to close the door behind him, the door hits on the wheels of the wheelchair and makes it difficult to close the door. In an attempt to avoid contact between the door and wheelchair, the person in the wheelchair frequently goes through the door, turns around and goes back inside the door and backs out while grasping the door in an attempt to pull the door to its closed position. This maneuver is also difficult.

It is therefore a principal object of the invention to provide a means for a person in a wheelchair to close a door behind him.

A further object of the invention is to provide a pivotal handle which is mounted on a door adjacent the hinge side of the door to enable a door to be easily moved from its open position to its closed position.

A further object of the invention is to provide an apparatus of the type described which does not interfere with the normal operation of the door.

Still another object of the invention is to provide an auxiliary handle for a door which is economical of manufacture, durable in use and refined in appearance.

These and other objects will be apparent to those skilled in the art.

SUMMARY OF THE INVENTION

An auxiliary handle is described to enable a person in a wheelchair or the like to conveniently close a door behind him. The auxiliary handle comprises a bracket which is mounted on one side of the door adjacent the hinge of the door. The handle is pivotally moved from an inoperative position to an operative position so that the handle may be grapsed to pull the door from its open position to its closed position.

DESCRIPTION OF THE PREFERRED EMBODIMENT

Figure 1:
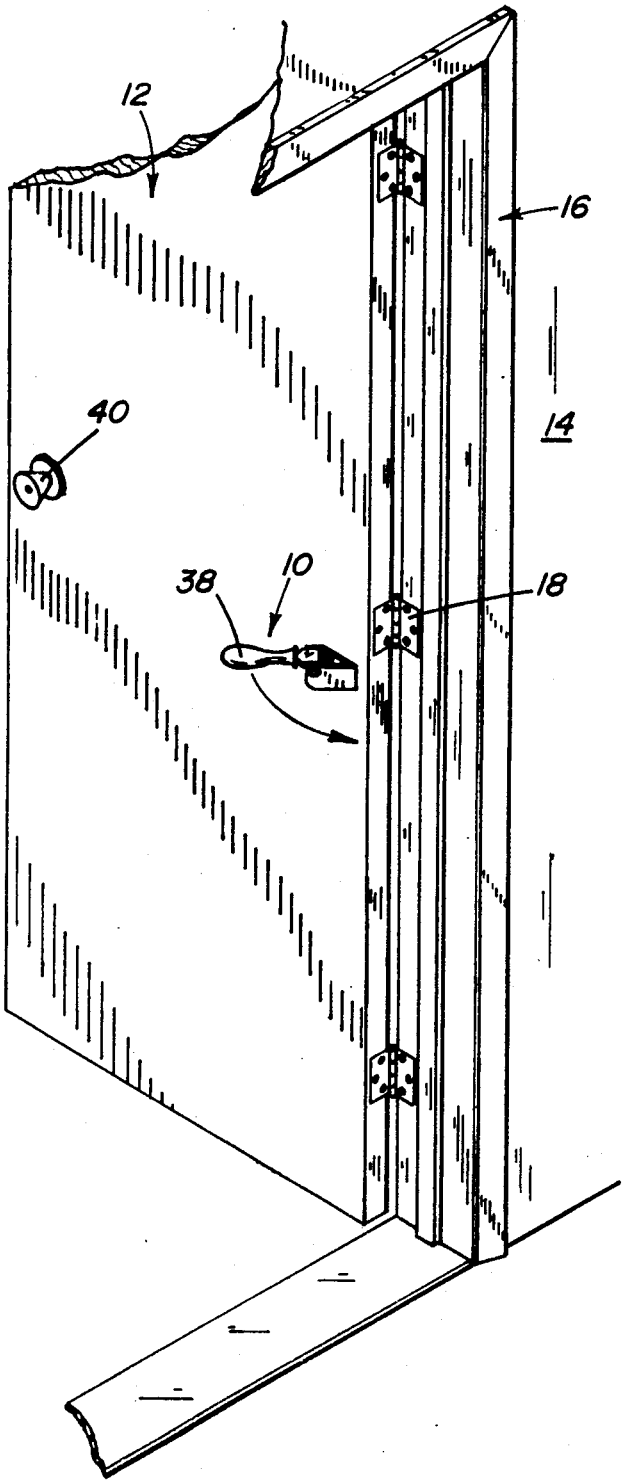
FIG. 1 is a perspective view of the handle of this invention mounted on a door.

The handle of this invention is referred to generally by the reference numeral 10 while the numeral 12 refers to a door which is mounted in a door opening in a wall 14 having a casement means 16 extending around the door opening. Door 12 is hingedly secured to casement means 16 by hinges 18 so that the door may be moved from the open position illustrated in FIG. 1 to the closed position illustrated in FIG. 5.

Handle means 10 comprises a bracket 20 including a base portion 22 which is secured to door 12 by screws

24. A pair of legs 26 and 28 extend horizontally outwardly from base portion 22 at an angle to the plain of the door 12 as illustrated in the drawings. U-shaped bracket 30 is pivotally secured to legs 26 and 28 of bracket 20 by means of pin 32. Weld nut 34 is secured to bracket 30 and threadably receives stud 36 extending from handle member 38. Pin 32 provides the pivotal connected between the handle member 38 and the bracket 20 so that the handle member 38 may be pivotally moved upwardly from the inoperative position of FIG. 2 to the operative position of FIG. 3.

Figure 2:
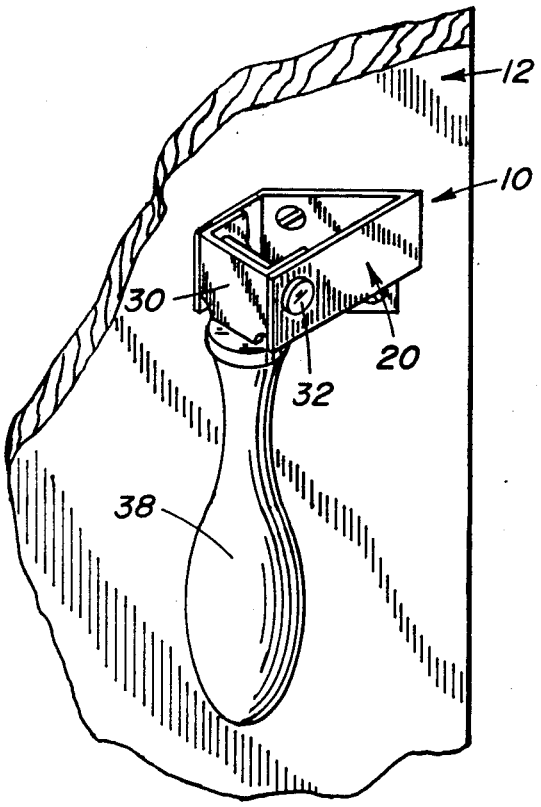
FIG. 2 is a perspective view of the handle mounted on a door.
Figure 3:
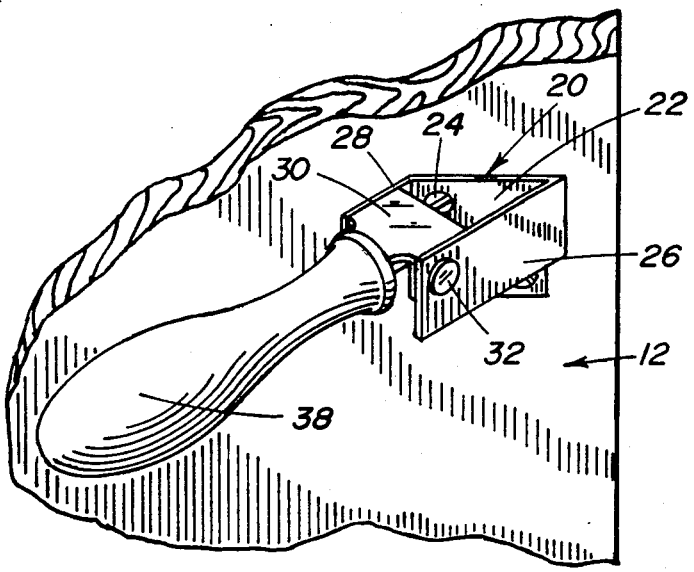
FIG. 3 is a view similar to FIG. 2 except that the handle has been moved from its inoperative position to its operative position.
Figure 4:
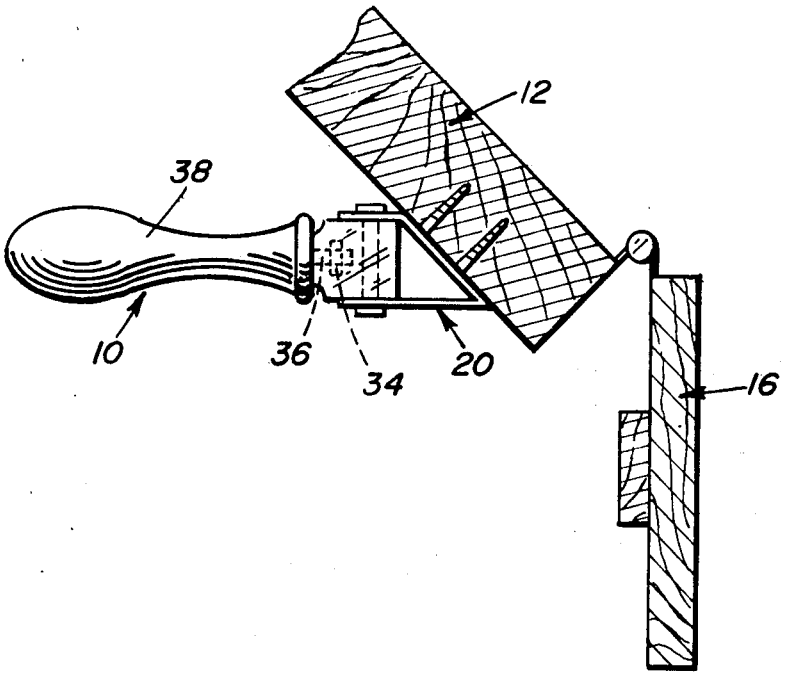
FIG. 4 is a top view of the handle in its operative position with the door and door casement being shown in section.
Figure 5:
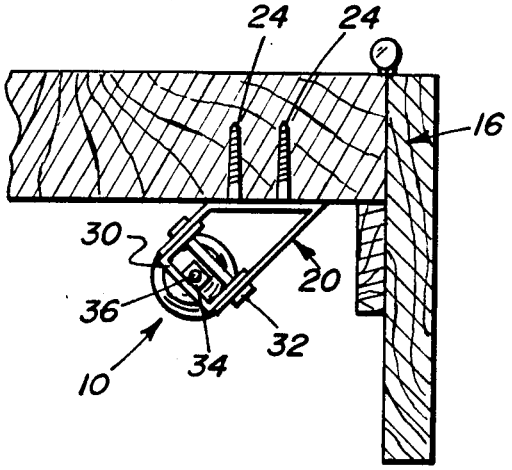
FIG. 5 is a view similar to FIG. 4 except that the door has been closed and the handle has been moved to its inoperative position.

The handle 10 is mounted on the door 12 by means of the screws 24 as illustrated in the drawings. The handle 10 is mounted on the door 12 adjacent the hinge connection of the door with the casement and is preferably located approximately at the same height as the door knob 40. When the door is in the closed position as illustrated in FIGS. 2 and 5, the handle 38 is substantially vertically disposed so that the auxiliary handle 10 does not interfere with the normal operation of the door. When the door has been moved to the open position of FIG. 1 and it is desired to close the door, the handle member 38 is pivotally moved upwardly from the position of FIGS. 2 and 5 to the position of FIGS. 1 and 4. The handle member 38 is then grasped to pull the door to the closed position. The angular relationship of the legs 26 and 28 with respect to the plane of the door provides additional leverage for the person attempting to close the door. When the door is closed, the handle member 38 is released so that it returns to its vertically disposed position of FIG. 5.

Thus it can be seen that a novel auxiliary handle has been provided for use with a door to enable a person in a wheelchair or the like to conveniently close the door behind him. It can therefore be seen that the invention accomplishes at least all of its stated objectives.

I claim:

1. In combination, a wall means having a door opening formed therein, a door casement means extending at least partially around said door opening including a top casement member having first and second side casement members extending downwardly from opposite ends thereof, a door including opposite sides, top and bottom edges, and opposite sides edges, hinge means hingedly securing one of said side edges of said door to said first casemenet member whereby said door may be moved between open and closed positions, a door knob attached to the door adjacent the other of said side edges of said door, an auxiliary handle secured to one of said sides of said door adjacent said one side edge thereof whereby said handle may be grasped, when said door is in its open position, to pull said door towards its closed position, said auxiliary handle being at approximately the same height and spaced from the door knob, said auxiliary handle being pivotally mounted on said door so that it may be moved between an inoperative and operative positions, said auxiliary handle comprises a bracket secured to said door and a handle member pivotally secured to said bracket, said handle member being disposed at an acute angle relative to the door and angled toward the door knob, said bracket comprises a base portion secured to said door and a pair of spaced-apart legs secured thereto and extending therefrom, said handle member being pivotally secured to said legs, said legs extend outwardly and horizontally from said base portion toward said other of said side edges at an acute angle to the plane of said door, the leg closer to the door knob being shorter in length than the other leg.

* * * * *